United States Patent [19]

Strong et al.

[11] 4,222,248

[45] Sep. 16, 1980

[54] KNOCKOVER BAR ASSEMBLIES

[75] Inventors: Barry C. Strong, Syston; Eric W. Marriott, Shepshed; William Clayton, Leicester, all of England

[73] Assignee: William Cotton Limited, Leicestershire, England

[21] Appl. No.: 942,634

[22] Filed: Sep. 15, 1978

[30] Foreign Application Priority Data

Sep. 17, 1977 [GB] United Kingdom ..... 38845/77

[51] Int. Cl.[2] ..... D04B 11/00; D04B 21/00

[52] U.S. Cl. ..... 66/82 R

[58] Field of Search ..... 66/82

[56] References Cited

U.S. PATENT DOCUMENTS

| | | | |
|---|---|---|---|
| 621,723 | 3/1899 | Lowe | 66/88 |
| 1,874,108 | 8/1932 | Lieberknecht | 66/82 R |
| 2,731,818 | 1/1956 | Lynam et al. | 66/82 R |
| 3,397,555 | 8/1968 | Blood et al. | 66/90 X |

FOREIGN PATENT DOCUMENTS

| | | | |
|---|---|---|---|
| 732931 | 6/1955 | United Kingdom | 66/82 |

*Primary Examiner*—Ronald Feldbaum

*Attorney, Agent, or Firm*—Robert E. Burns; Emmanuel J. Lobato; Bruce L. Adams

[57] ABSTRACT

A straight bar knitting machine for example of the Cotton's Patent type has (see FIG. 1) a shaft (4) which is resistant to torque located inside a knitting head (H) to reduce distortion of a knockover bar (2) located between a needle bar (33) and a sinker bar (30) by means of means (8,10,12) which interconnect the knockover bar and the shaft in such a way that the shaft oscillates concurrently with the reciprocation of the knockover bar.

8 Claims, 4 Drawing Figures

KNOCKOVER BAR ASSEMBLIES

DESCRIPTION

Field of Invention

The invention relates to knockover bar assemblies for use in straight bar knitting machines such as Cotton's Patent type machines. In straight bar knitting machines bearded needles (i.e. needles whose hooks are closed by pressing a sprung "beard portion" onto a stem portion) on a common needle bar perform a joint knitting cycle in cooperation with sinkers which penetrate between the needles to draw yarn fed by a traversable carrier into loops and knockover bits on a knockover bar which knockover newly formed loops over the top of the bearded needles.

Background of Invention

In known straight bar knitting machines, knockover bars are mounted and actuated by drive arrangements to impart lift or up-down motion and advancement or in-out motion to the knockover bar. For both lift and advance motion of the knockover bar there are provided: a cam, a cam follower on a lever arm fixed to a motion shaft, lever arms on the motion shaft at each knitting head operating a connecting arm between the lever arm and the knockover bar. For the advance in particular, lever arms are fastened to the advance motion shaft at each end of the knitting head and a pair of connecting arms extend from the ends of the lever arms at the front of a needle bar past the ends of the needle bar to the ends of the knockover bar. The shaft for the advance motion of the knockover bar is well below and in front of a knitting head formed by the compactly arranged needle bar, knockover bar, head rail and sinker bar. Such an arrangement is exemplified in the U.S. Pat. No. 3,397,555.

The knockover bar is confined by a needle bar on one side and a head rail on the other side. This limits the thickness of the knockover bar and the extent of its to-and-fro movement. In-out reciprocation at speed causes distortion of the knockover bar by bending but the extent to which distortion can be counteracted by mechanical strengthening of the knockover bar is limited by the space available. The attendant increase in knockover bar inertia would in any event hinder high speed operation.

It is the object of the invention to provide a knockover bar of light weight which is mobile, compact and capable of high speed operation.

DESCRIPTION OF THE INVENTION

According to this invention there is provided a straight bar knitting machine having a knitting head with a knockover bar, which is reciprocable, arranged between a needle bar and a sinker bar in which a shaft is oscillatably mounted in and extends longitudinally through the knitting head along the knockover bar and means interconnecting the knockover bar between its ends and the shaft so that the shaft oscillates concurrently with reciprocation of the knockover bar resists distortion of the knockover bar between its ends.

The shaft, which is resistant to deformation under torque and so transmits motion along its length, is thus located inside the knitting head close to the knockover bar and stabilizes the knockover bar without requiring enlargement of the movable body of the knockover bar. Thus the knockover bar can be stabilized without impinging appreciably on the space available for its movement. The inertia is only increased to a small extent by providing the currently oscillatable torque shaft. Because of the proximity of the shaft and knockover bar and their location in the knitting head, the construction of the pivotal means can be adapted to provide optimal results without undue obstruction by other knitting components. The interconnecting means may be any arrangement whereby the knockover bar can be pivotted with respect to the shaft so that oscillation of the shaft coincides with reciprocal movement of the knockover bar. Such interconnecting means are conveniently arranged so as to permit movement of the knockover bar in one sense, generally up-down, without affecting the shaft but ensures conjoint movement of the knockover bar and the shaft when the knockover bar moves in the other sense to provide stabilisation. Such a manner of interconnecting can be conveniently achieved by pivotal linkages which hinge the knockover bar and the shaft together.

Preferably the pivotal linkage comprises a plurality of links spaced along the knockover bar and connected to the shaft at at least one position which is intermediate bearings supporting the shaft, the shaft being pivotably connected eccentrically to the links to impart in-out reciprocation whilst the knockover bar is supported and actuated for up-down motion by upright support arms.

The links are rigid yet light and provide a direct connection between the knockover bar and shaft so as to ensure their concurrent motion and effective stabilizing of the knockover bar, even at high reciprocation speeds. The shaft thus performs the dual function of stabilizing the knockover bar against distortion as well as actuating the in-out motion and avoiding end-wise actuation of the knockover bar.

The knockover bar, the shaft and the interconnecting links may be made and sold independently and can then be recognised by the proximity of the knockover bar and the shaft and the shortness and lateral distribution of the links. As many links may be used as are necessary to control deformation or flapping of the knockover bar due to reciprocation in operation of the straight bar knitting machine. Advantageously at least three links are provided. The shaft should be sufficiently rigid to cause the links to move in precise synchronism in operation of the straight bar knitting machine and to avoid distortion of the knockover bar. It is preferred that the pivotal means comprise a plurality of links pivotably connected at one end to an upper portion of the knockover bar and pivotably connected at the other end to an arm extending upwardly from the shaft and the shaft is journalled in bearings formed by blocks extending between a head rail and the sinker bar so that the links are reciprocated just below the sinker bar. The shaft is thus located to the rear of the knockover bar. The shaft may in a less preferred construction be mounted in bearing means at the front of the head rail.

By using the links which are pivoted at each end, the knockover bar can firmly be secured to the upright support arms. The links thus only transmit in-out motion and hold the knockover bar against distortion in a substantially horizontal plane. The bearings and shaft are accommodated in the knitting head without requiring much knitting head enlargement, if any, and the links transmit the in-out motion close to a part of the knockover bar mounting knockover bits which do the actual knocking over. The bearings and arm-link connections can be located at spaced positions along the shaft assisting firm location of the shaft and hence reducing knockover bar distortion.

The invention incorporates a shaft into the knitting head (whose extent can be regarded as being between the needle bar on one side of the knitting head, a jack bar on the side of the knitting head and below the sinker bar and substantially above the lower end of the head rail) and so provides a number of benefits including: the use of the shaft to hold the knockover bar stable along its length at as many positions as is necessary for the purpose, permitting a slender knockover bar construction, the direct connection of the links substantially behind the knockover bits, and possible simplification of the drive mechanism surrounding the knitting head by the absence of end-wise knockover bar actuation.

Preferably the links are of a length of from 0.5 to 2 times, conveniently 1 time the diameter of the shaft so that the shaft may be brought closely along the rear of the knockover bar with the links spaced vertically from the shaft.

Advantageously the knockover bar has an upper portion with clamps for the knockover bits and a plate like lower portion for connection to the knock-over bar up-down connecting arms. The up-down support arms and the shaft may be controlled from appropriate rotatable cams on a cam shaft of the straight bar knitting machine. As the links and shaft resist flapping of the knockover bar, the thickness of the lower portion of the knockover bar can be reduced whilst maintaining sufficient stability and possibly increasing mobility.

The length of the links can be selected so as to permit accommodation of an appropriate range of up-down and in-out motions for different gauges of straight bar knitting machines such as 15 to 33 gauge machines.

Advantageously at least one nog, in which the shaft is journalled, is provided at an intermediate position along the knockover bar. The links may be pivotably connected to the clamps of the knockover bar.

Conveniently the shaft and links are mounted to permit an arc of movement of approx 30° for the in-out movement of the knockover bar and an arc of movement of approx 25° for the movement of the links to accommodate the up-down movement.

By stabilizing the knockover bar without requiring additional space, improved knitting head configuration whose overall dimensions may be up to 30% below those of conventional machines of the same gauge is made possible. A thin knockover bar together with the shaft can also be located under a reduced thickness sinker bar whilst still operating with sufficient stability. The knockover bar and shaft assembly may be used on conventional straight bar machines to increase mobility and smooth operating at speed or may be used for machines specifically designed to operate at high speeds to achieve knitting speed substantially in excess of what was possible hitherto.

CONSTRUCTION

Figure 1:
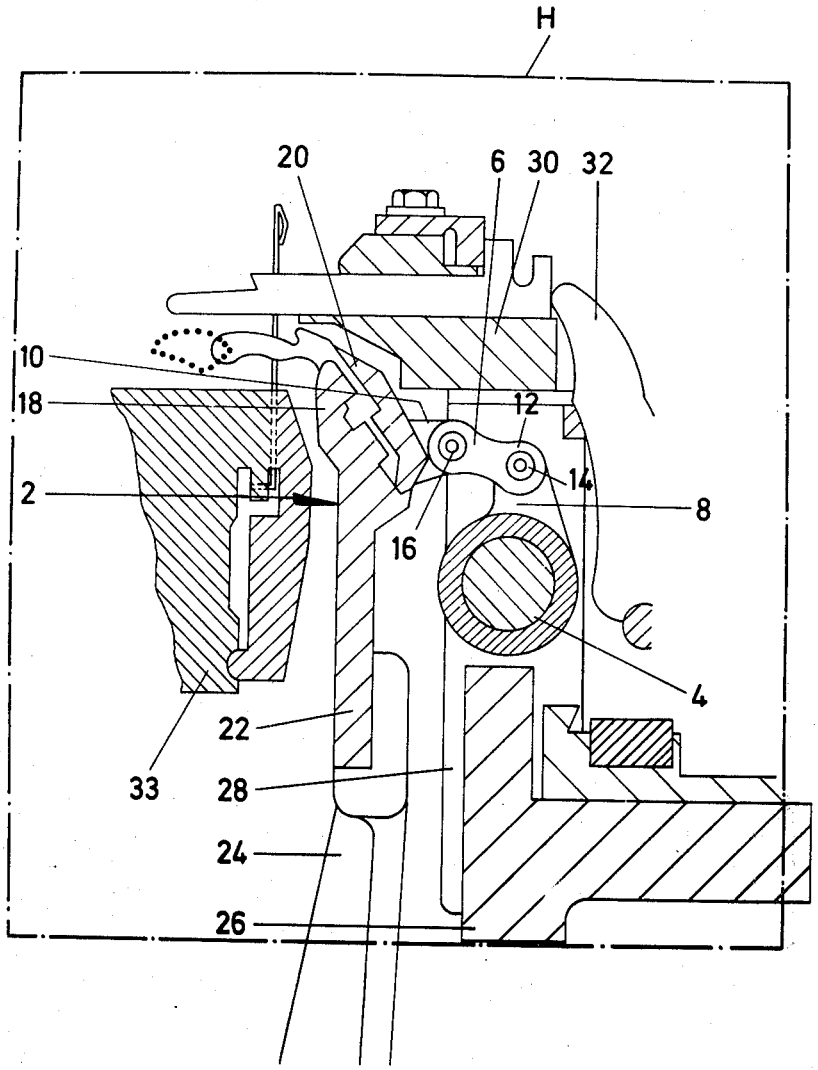
FIG. 1 shows a section through a head rail and sinker and knockover bar assembly according to the invention at one extreme of movement of the knockover bar.
Figure 3:
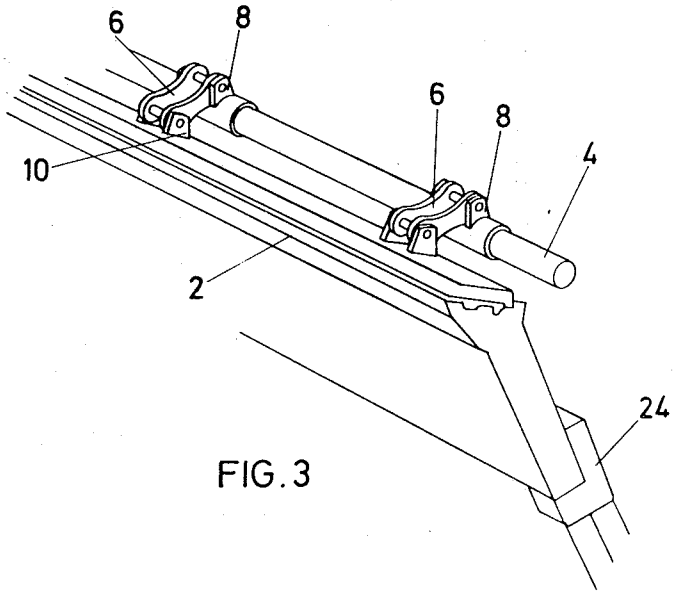
FIG. 3 shows a perspective view of the knockover bar assembly of FIGS. 1 and 2.
Figure 2:
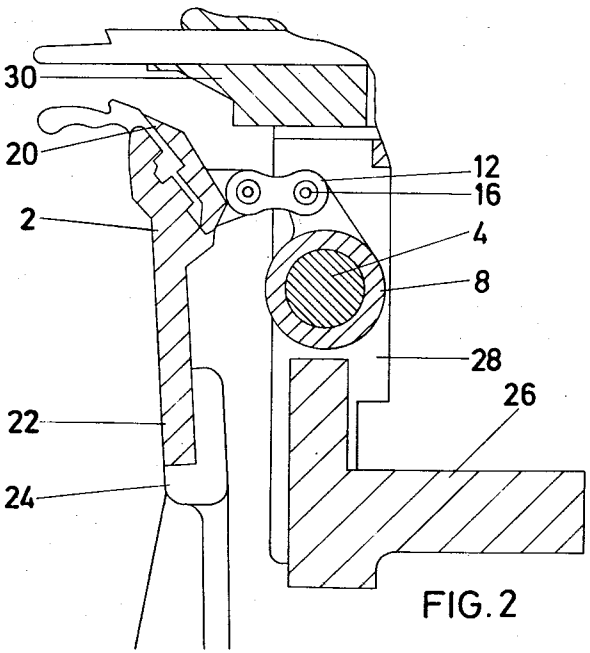
FIG. 2 shows a section through the knockover bar assembly at another extreme of movement of the knockover bar.

With reference to FIGS. 1 and 3, a knockover bar assembly of for example a Cotton's Patent type straight bar knitting machine comprises a knockover bar 2 connected at a plurality of positions to a torque resistant shaft 4 by links 6. The links 6 are pivotably connected to a knockover bar mounting bracket 10 at one end and torque shaft mounting arm 8 at the other end. Each link 6 comprises side plates 12 held together by bushes 14 which are rotatably received on pivot pins 16 secured to the arms 8 and brackets 10.

The knockover bar 2 has a top part 18 with a clamp plate 20 for fastening knockover bits and mounting the brackets 10 supported by a thin, plate like bottom part 22 supported at each end and/or intermediate positions by up-down connecting arms 24 of the straight bar knitting machine. The clamp plate 20 is suitably secured to the top part 18, e.g. by screws. The knockover bar assembly is supported by the up-down connecting arms 24 and by nogs 28 mounted on a head rail 26 of the knitting machine which each have an aperture forming a bearing 31 for the shaft 4. The nogs 28, located halfway between adjacent links 6 also support a sinker bar 30. The torque shaft 4 is fitted just in front of a jack bar assembly 32. The knockover bar 2 is fitted between a needle bar 33 and the jack bar assembly 32.

Figure 4:
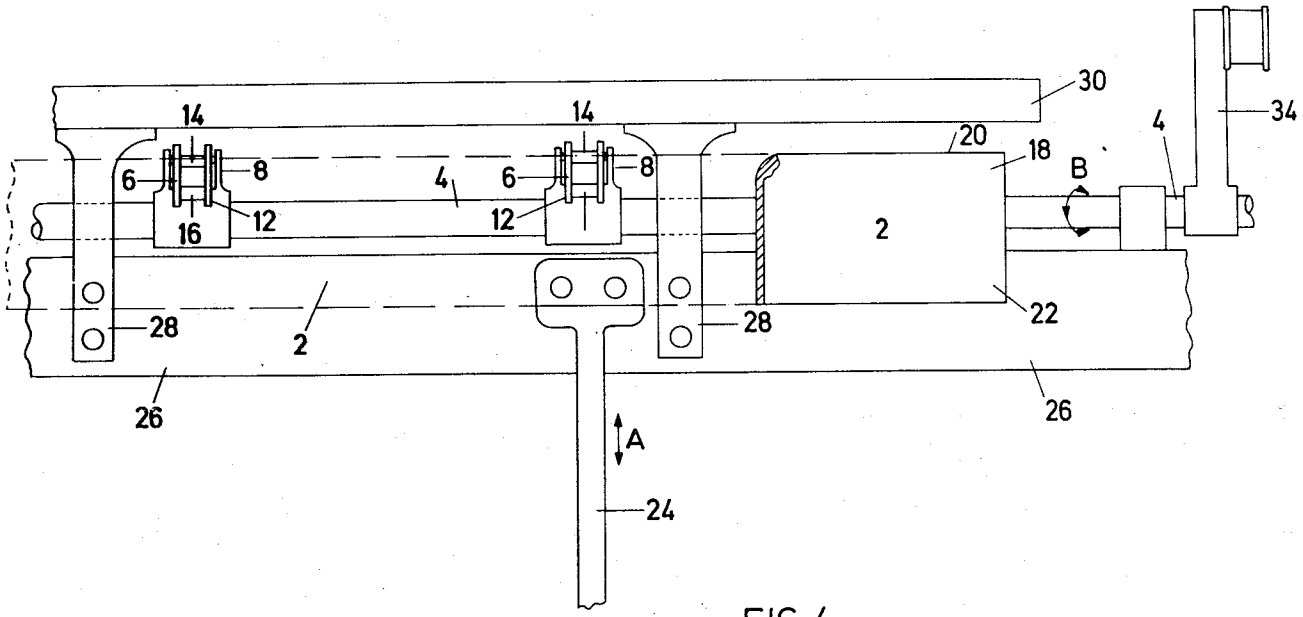
FIG. 4 shows a front view with parts cut away of the knockover bar assembly of FIGS. 1 to 3.

The knockover bar assembly is actuated by cams and levers as shown by arrows A and B in FIG. 4. The arrangement of the cams and levers is not material to the invention provided the correct reciprocation of the knockover bar is achieved. It is desirable that the torque shaft be a secondary shaft in the overall actuation and that the torque shaft is rotated at one or preferably both ends by a secondary lever 34 which is in turn actuated by a link and a cam driven primary lever on another shaft.

In operation of the straight bar knitting machine, cams (not shown) cause the connecting arms 24 to move up or down in synchronism with an oscillating angular movement of the shaft 4 which may be controlled at one or both sides of a knitting head. The overall movement of the knockover bar is illustrated in dotted lines in FIG. 1. As the knockover bar 2 is plate-like high speed reciprocation in the up-down direction does not lead to deformation of the knockover bar 2 in a vertical plane. The up-down motion of the connecting arms 24 causes the links 12 to pivot on the pins 16 of connecting arms 8 without causing a substantial resultant in-out component of movement.

The movement of the shaft 4 is transmitted simultaneously by the links 6 to the rear of the knockover bar 2 at a number of positions. The rigidity of the shaft 4 and its connection with the links 6 prevents undue deformation of the knockover bar 2 in a horizontal plane even though the knockover bar itself is not very resistant against deformation in that plane. The shaft 4 thus enables high speed in-out reciprocation of the knockover bar 2 to be achieved.

The knockover bar assembly illustrated as a separate entity in FIG. 3 can be incorporated giving a compact overall knitting head assembly as shown in FIG. 1. The knockover bar 2 can be fitted closely alongside a headrail sinker bar assembly, whilst the shaft 4 is located between the head rail 26 and the sinker bar 30 with the links generally positioned above the shaft 4. The knitting head extent in this case is indicated by the box H in FIG. 1.

Figure 5A:
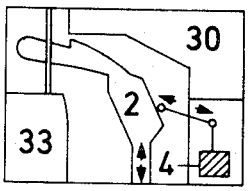
FIGS. 5A to 5E show different versions of the invention schematically.
Figure 5B:
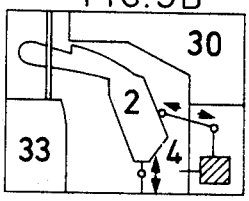
Figure 5E:
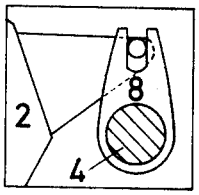
Figure 5C:
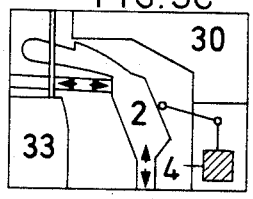
Figure 5D:
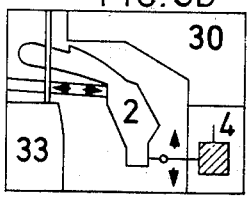

The knockover bar assembly may be adapted for high speed operation or low speed operation in which case it can be constructed more lightly. It may be used on multi-section and single section straight bar machines. With reference to FIGS. 5B to F some modified straight bar knitting machines are illustrated in which a torque shaft 4 also stabilizes a knockover bar even though the arrangements may be less efficient than that described in detail previously and illustrated in FIG. 5A. The arrows indicate the knockover bar up-down and in-out motions. In FIG. 5B there is illustrated an embodiment in which an arm extends at a fixed attitude with respect to the knockover bar to the rear for pivotal connection eccentrically to an arm on the torque shaft 4. To permit in-out movement of the knockover bar it may be flexibly supported on the up-down support arm or as in FIG. 5E there may be a pin and slot pivotal connection which permits up-down movement of the knockover bar and rear arm with respect to the torque shaft. FIG. 5C illustrates an arrangement wherein the torque shaft is used in a purely stabilising function, in-out movement being imparted in the first instance to the ends of the knockover bar and only indirectly to intermediate parts of the knockover bar by the torque shaft and links. FIG. 5D illustrates the use of the torque shaft 4 to stabilise the knockover bar during in-out motion and to actuate the knockover bar for up-down motion. In all these arrangements the torque shaft is held in longitudinal alignment by suitable bearing surfaces under the sinker bar and is connected to the knockover bar at intermediate position to reduce distortion of the knockover bar.

What is claimed is:

1. Straight bar knitting machine having a knitting head comprising a head rail, a needle bar carrying a multiplicity of needles, a sinker bar spaced rearwardly from said needle bar, a reciprocable knockover bar arranged between said needle bar and said sinker bar, a shaft extending along and to the rear of said knockover bar, a plurality of mutually spaced bearing means rotatably supporting said shaft at spaced positions along its length for oscillation of said shaft and a plurality of means interconnecting said knockover bar with said shaft at positions between pairs of neighboring bearing means for reciprocating said knockover bar upon oscillation of said shaft and resisting distortion of said knockover bar between its ends.

2. Straight bar knitting machine according to claim 1, in which said interconnecting means comprises arms fixed on said shaft and pivoted links connecting said arms with said knockover bar.

3. Straight bar knitting machine according to claim 2, in which there are at least three of said links spaced along the length of said shaft, and in which said bearing means support said shaft between said links.

4. Straight bar knitting machine according to claim 2, in which the length of said links is between 0.5 and 2 times the diameter of said shaft.

5. Straight bar knitting machine according to claim 2, in which said links extend generally perpendicularly to said knockover bar.

6. Straight bar knitting machine according to claim 1, in which said knockover bar is generally flat with its width extending generally perpendicular to the direction of movement of said knockover bar by said shaft and connecting means.

7. Straight bar knitting machine according to claim 1, in which said shaft is located between said head rail and said sinker bar.

8. Straight bar knitting machine according to claim 1, in which said bearing means comprise support members interposed between said head rail and said sinker bar.

* * * * *